US009610472B2

(12) United States Patent
Willis

(10) Patent No.: US 9,610,472 B2
(45) Date of Patent: Apr. 4, 2017

(54) YOGA MATS

(71) Applicant: Michael Allen Willis, Garden Grove, CA (US)

(72) Inventor: Michael Allen Willis, Garden Grove, CA (US)

( * ) Notice: Subject to any disclaimer, the term of this patent is extended or adjusted under 35 U.S.C. 154(b) by 0 days.

(21) Appl. No.: 14/470,815

(22) Filed: Aug. 27, 2014

(65) Prior Publication Data

US 2016/0059066 A1 Mar. 3, 2016

(51) Int. Cl.
*A47G 9/06* (2006.01)
*A63B 21/00* (2006.01)
*A47G 27/02* (2006.01)

(52) U.S. Cl.
CPC ..... *A63B 21/1473* (2013.01); *A63B 21/4037* (2015.10); *A47G 27/0237* (2013.01)

(58) Field of Classification Search
CPC ..... A47G 9/06
USPC ..... 5/417–420
See application file for complete search history.

(56) References Cited

U.S. PATENT DOCUMENTS 2,540,165 A * 2/1951 Fiel ..... A45C 3/10 190/111
4,154,323 A * 5/1979 Sneider ..... 190/2
4,609,580 A 9/1986 Rockett et al.
D389,642 S 1/1998 Nadel
6,640,359 B1 11/2003 Alane
6,641,196 B1 11/2003 Hanagan
6,742,635 B2 * 6/2004 Hirshberg ..... A45C 9/00 190/2
6,751,816 B1 6/2004 Wechsler
7,108,635 B2 9/2006 Howlett-Campanella
D530,512 S 10/2006 Palaszek
D554,208 S 10/2007 Palaszek
D565,339 S 4/2008 Gunnarsson
D572,068 S 7/2008 Lin
D584,093 S 1/2009 Drumm
D589,289 S 3/2009 Laure
D599,149 S 9/2009 White
7,955,224 B2 6/2011 Curley
D646,517 S 10/2011 Noonan
8,075,464 B2 12/2011 Hayes et al.
D653,894 S 2/2012 Kieffer
D657,987 S 4/2012 Lane
D660,068 S 5/2012 Wang
8,192,330 B2 6/2012 Curley
8,317,660 B2 11/2012 Goranson
D671,784 S 12/2012 Gallie, II
D674,226 S 1/2013 Greenwald
D678,703 S 3/2013 Ntoukas
D688,068 S 8/2013 Ntoukas
8,510,878 B2 8/2013 Wang
8,607,381 B2 12/2013 Woods et al.
D698,187 S 1/2014 Kazarska et al.
D699,979 S 2/2014 Tamayo
(Continued)

OTHER PUBLICATIONS

PCT International Search Report dated Feb. 2, 2016 in related PCT Application No. PCT/US2015/047033.

*Primary Examiner* — Fredrick Conley
(74) *Attorney, Agent, or Firm* — Robert D. Buyan; Stout, Uxa & Buyan, LLP

(57) ABSTRACT

Yoga mat devices which generally comprise a yoga mat having one or more storage compartment(s). Also disclosed are related methods of manufacture and use of such devices.

27 Claims, 6 Drawing Sheets

(56) References Cited

U.S. PATENT DOCUMENTS

| | | | | |
|---|---|---|---|---|
| D699,980 | S | 2/2014 | Tamayo | |
| D702,970 | S | 4/2014 | Coco | |
| 2004/0250346 | A1 | 12/2004 | Vasishth | |
| 2005/0172402 | A1 | 8/2005 | Uretzky-Miller | |
| 2005/0192158 | A1 | 9/2005 | Edwards | |
| 2006/0073305 | A1 | 4/2006 | Kole | |
| 2007/0275827 | A1 | 11/2007 | Glaser | |
| 2008/0127414 | A1* | 6/2008 | Allen | 5/417 |
| 2009/0078662 | A1 | 3/2009 | Boehm Clifton | |
| 2009/0178267 | A1 | 7/2009 | Axelrod | |
| 2009/0241260 | A1 | 10/2009 | Noonan | |
| 2009/0260157 | A1* | 10/2009 | Gere | 5/417 |
| 2010/0267535 | A1 | 10/2010 | Kieffer | |
| 2012/0076981 | A1 | 3/2012 | Franks et al. | |
| 2012/0304382 | A1 | 12/2012 | Sole | |
| 2012/0324645 | A1 | 12/2012 | Lehr | |
| 2013/0042408 | A1 | 2/2013 | Sun | |
| 2013/0180048 | A1 | 7/2013 | Saltzman | |
| 2014/0069970 | A1 | 3/2014 | Thomas | |

* cited by examiner

YOGA MATS

FIELD OF THE INVENTION

The present invention relates generally to the fields of exercise, meditation and holistic health and more particularly to yoga mats used in the practice of yoga.

BACKGROUND OF THE INVENTION

Pursuant to 37 CFR 1.71(e), this patent document contains material which is subject to copyright protection and the owner of this patent document reserves all copyright rights whatsoever.

Various types of styles of yoga have existed and been practiced over the years. The modern-day practice of toga in Western cultures typically involves physical postures or poses, breathing control techniques, and meditation. Commonly, a group of persons may gather in a single room to practice yoga under the lead of an instructor (sometimes referred to as a "yogacharya"). It is typical for each person in the room to sit or stand on an individual yoga mat throughout each yoga session. While some yoga studios do make lockers available for storage of personal items cell phones, keys, sun glasses and yoga mat carrying bags, it is not unusual for persons to eschew use of such lockers, opting instead to place such personal items on the floor near their yoga respective yoga mats. Also, individuals often wish to have work out towels with them while practicing yoga and such towels are commonly placed on the floor along with their other items of personal property. Such items lying on the floor can be unsightly and/or may present a slip-and-fall hazard.

A standard yoga mat typically comprises a sheet of foamed or solid elastomeric material (e.g., polyvinyl chloride (PVC)) having a thickness in the range of about ⅙ inch to about ¼ inch. In some more complex yoga mats, a plurality of layers of different material are used. For example, yoga mats sold for use in hot yoga or Bikram yoga may have an absorbent upper layer (e.g., terry cloth material) permanently affixed to an elastomeric mat lower layer such that the elastomeric lower layer will contact the underlying floor while the yoga practitioner sits/stands on the towel-like upper layer. The towel like upper layer may then absorb perspiration. One commercially available example is the Breath™ Yoga Mat marketed by Breathe Yoga Mats or Vancouver, British Columbia which has a cotton terry top layer, a middle layer of absorbent cushioning fibers and a coated, brushed bottom layer for gripping the underlying floor surface. However, the multi-layer yoga mats of the prior art have typically not been designed to permit periodic detachment and laundering of the upper perspiration-absorbing layer.

The prior art has also included various other purported improvements and accessories relating to yoga mats, including those described in: U.S. Pat. No. 8,607,381 entitled Yoga Mat; U.S. Pat. No. 8,317,660 entitled Yoga Mat with Pose Markings; U.S. Pat. No. 8,192,330 entitled Yoga Mat with Intuitive Tactile for Visually Impaired; U.S. Pat. No. 7,955,224 entitled Yoga Mat with Intuitive Tactile Feedback for Visually Impaired; U.S. Pat. No. 7,108,635 entitled Yoga Mat with Body Contact Placement Indicia; U.S. Pat. No. 6,640,359 entitled Yoga Mat; U.S. Pat. No. 6,491,196 entitled Yoga Mat Holder; United States Patent Application Publication Nos. 2014/0069970 entitled Yoga Mat Carrying Bag Assembly; 2013/0180048 entitled Exercise Yoga Mat and Method of Using Same; 2013/0042408 entitled Smart Fold Yoga Mat; 2012/0324645 entitled Yoga Mat Incorporating Non-Slip Positioning Pads; 2012/0210512 entitled Yoga Mat; 2012/0076981 entitled Yoga Mat with Support and Traction; 2011/0118097 entitled Yoga Mat with Intuitive Tactile Feedback for Visually Impaired; 2011/0111926 entitled Yoga Mat with Pose Markings; 2010/00267535 entitled Yoga Mat; 2009/0241260 entitled Yoga Mat; 2009/0178267 entitled ID Clip for Yoga Mat; 2009/0078662 entitled Yoga Mat Storage Racks; 2009/0062076 entitled Yoga Mat with intuitive Tactile Feedback for Visually Impaired; 2007/0275827 entitled Yoga Mat; 2006/0073305 entitled Yoga Mat; 2005/0172402 Yoga Mat Carry Bag; 2004/0250346 entitled Anti-Slip Multi-Layer Yoga Mat; 2001/0034288 Yoga Mat with Body Contact Placement Indicia and the designs shown in U.S. Design Pat. Nos. D702,970; D699,980; D699,979; D698,187; D688,068; D678,703; D674,226; D671,784; D660,068; D657,987; D653,894; D646,517; D599,149; D589,289; D584,093; D572,068; D565,339; D554,208; D530,512 and D389,642. The entire disclosure of each of the patents and patent applications listed in this paragraph is expressly incorporated herein by reference.

SUMMARY OF THE INVENTIONS

The present invention provides yoga mats which have storage compartment(s) (e.g., one or more pockets, pouches, boxes, etc.) useable for storage of personal items.

The present invention also provides yoga mats having upper layers (e.g., fabric or perspiration absorbing material) which are detachable from underlying layer(s) of the may so as to be periodically laundered or replaced.

Further aspects and details of the present invention will be understood upon reading of the detailed description and examples set forth herebelow.

BRIEF DESCRIPTION OF THE DRAWINGS

The following detailed description and examples are provided for the purpose of non-exhaustively describing some, but not necessarily all, examples or embodiments of the invention, and shall not limit the scope of the invention in any way.

FIG. 3 A is a perspective view of a partially rolled yoga mat having a removable upper layer which may comprise fabric or other suitable material, in accordance with the present invention.

DETAILED DESCRIPTION OF THE INVENTION

The following detailed description and the accompanying drawings to which it refers are intended to describe some, but not necessarily all, examples or embodiments of the invention. The described embodiments are to be considered, in all respects, as only illustrative and not restrictive. The contents of this detailed description and the accompanying drawings do not limit the scope of the invention in any way.

Figure 1:
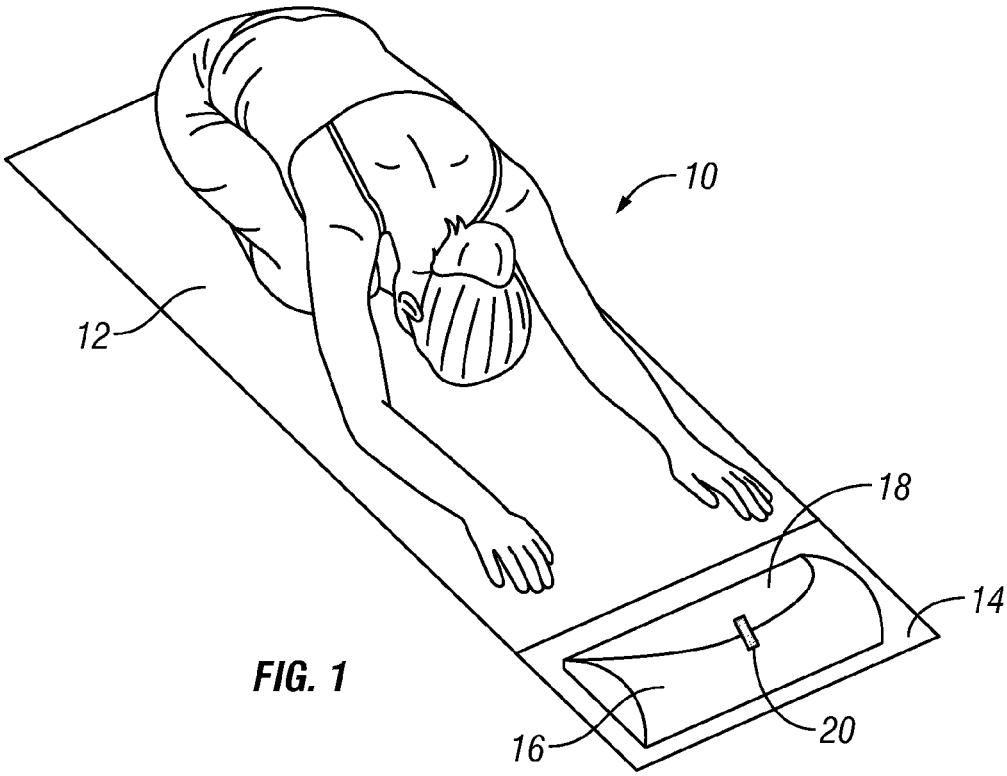
FIG. 1 is a perspective view of one example of a yoga mat which incorporates a storage compartment in accordance with the present invention.
Figure 1A:
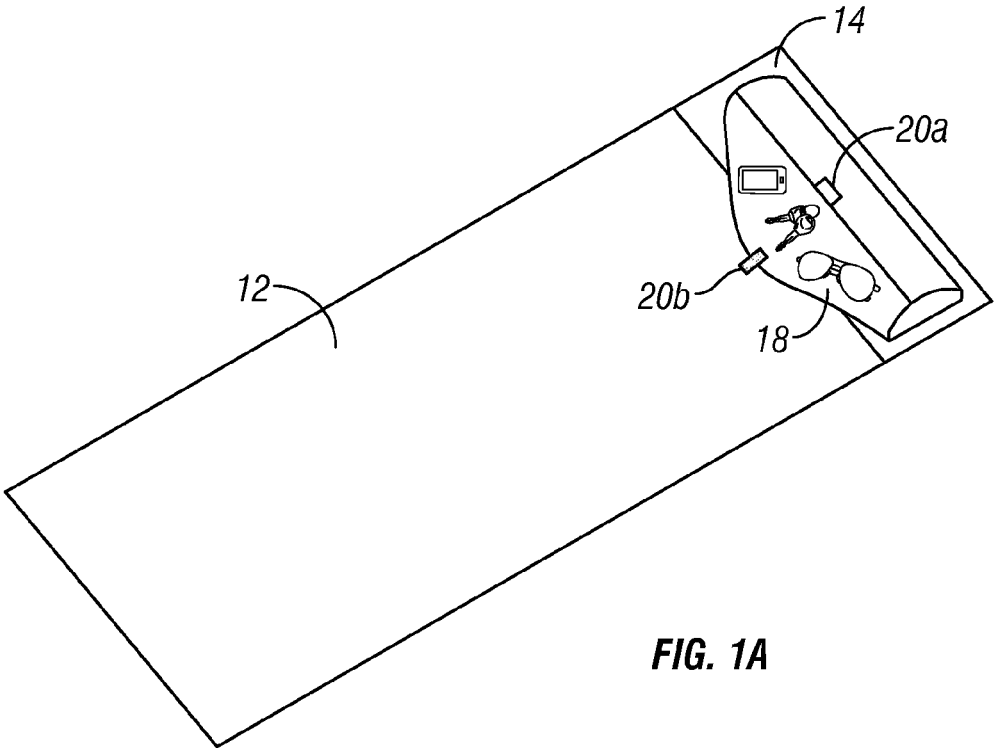
FIG. 1A is another perspective view of the yoga mat of FIG. 1 with its storage compartment closure flap in an open position exposing various items stored within the storage compartment.

FIGS. 1 and 1A show one example of a yoga mat device 10 of the present invention. In this example, the yoga mat device 10 comprises a yoga mat 12 having a storage compartment 14 attached to one end of the mat 12. The storage compartment in this example comprises a flat base panel having a flexible pouch 16 mounted thereon. The pouch 16 may include a closure flap 18 with an optional flap retaining apparatus 20 which retains positioning of the closure flap 18 when in the closed position as seen in FIG. 1. As shown in FIG. 1A, the flap retaining apparatus 20 may comprise a first member 20*b* on the flap 18 which is alternately engageable with and disengageable from a second member 20*b* on the wall of the pouch 16. Disengagement of the first member 20*a* from the second member 20*b* allows the closure flap 18 to be moved to an open position as illustrated in FIG. 1A.

Figure 2:
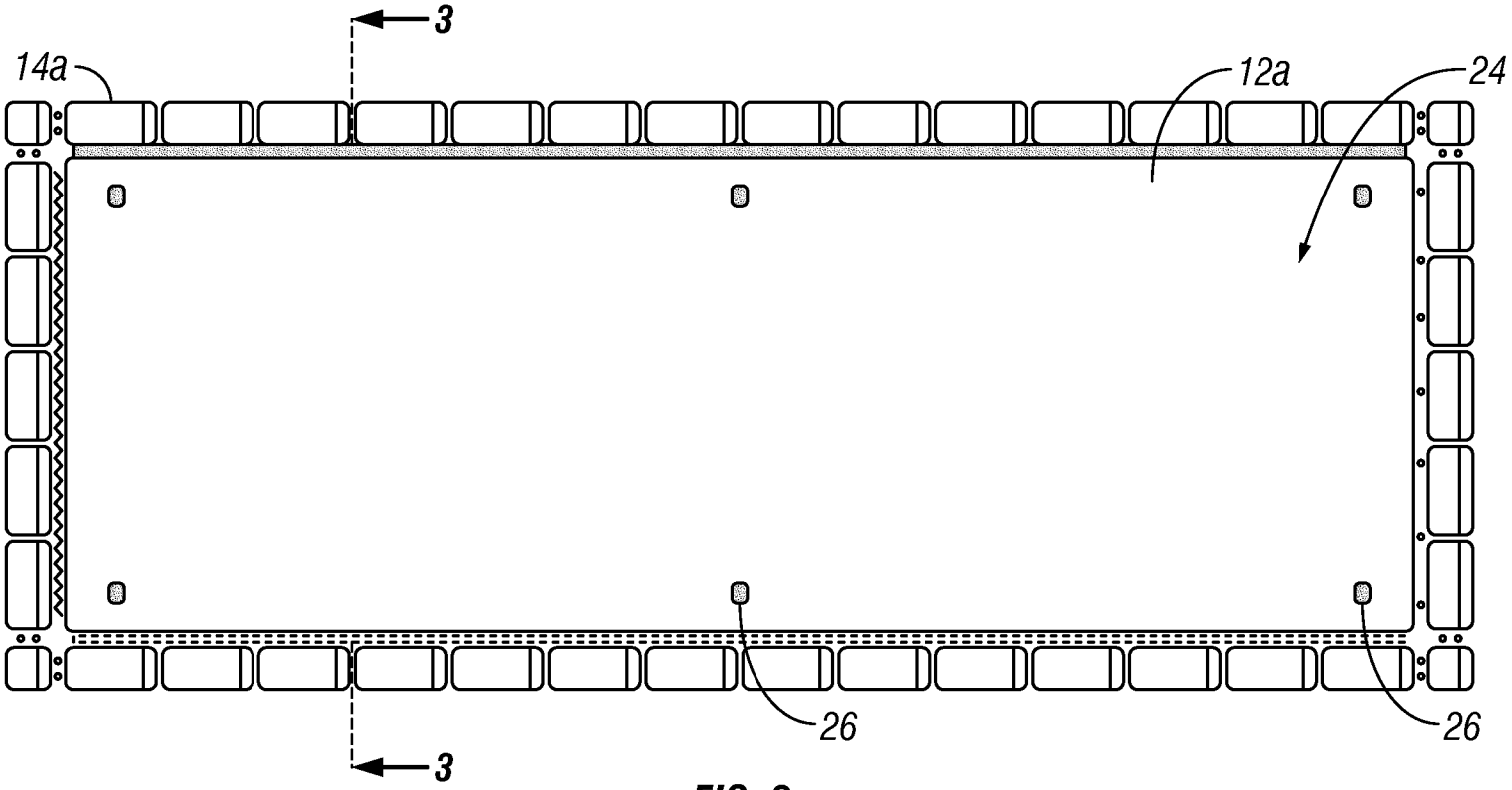
FIG. 2 is a top view of another example of a yoga mat of the present invention incorporating a plurality of storage compartments as well as a removable upper layer which may comprise soft or towel-like fabric or other suitable material.
Figure 2A:
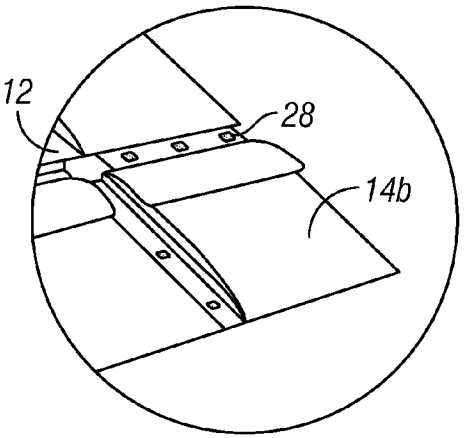
FIG. 2A is a diagram showing an example of a storage compartment attached to a yoga mat by way of snaps in accordance with the present invention.

It is to be appreciated that any number of storage compartment(s) 14, which may be of the same or differing size and/or type, may be permanently or detachably attached to some of all ends and/or sides of the yoga mat. In an illustrative example, FIG. 2 shows a yoga mat device which comprises a yoga mat 12*a* having numerous storage compartments 14*a* of varying size and/or type attached to both ends and both sides of the yoga mat 12*a* so that the entire yoga mat is substantially surrounded by storage compartments.

It is to be further appreciated that the yoga mat 12 may be of any suitable construction or type, including any of the yoga may designs or constructions disclosed in the patents and patent applications referenced and incorporated by reference above. Optionally, regardless of the particular construction or design of the mat itself, a removable upper layer may be provided on the mat in accordance with the present invention. In this regard, the yoga mat 12*a* seen in FIGS. 2-3A includes an optional removable upper layer 24 that is attached to the mat by way of connectors 26. The removable upper layer 24 may comprise any suitable material, such as a disposable or washable material. Examples of suitable materials include but are not limited to soft or absorbent paper, polymer, fabric material (e.g., paper towel, cotton fabric, polyester fabric, terry fabric, fleece, Sherpa fleece, microfiber material, etc.). In embodiments where the removable upper layer 24 is intended to be disposed of rather than laundered, the user may remove, dispose of and replace the upper layer 24 when the upper layer 24 becomes soiled or otherwise in need of replacement. In embodiments where the upper layer 24 is formed of washable material intended to be laundered or otherwise cleaned, the user may remove, launder or otherwise clean and then reattach the upper layer 24.

Figure 3:
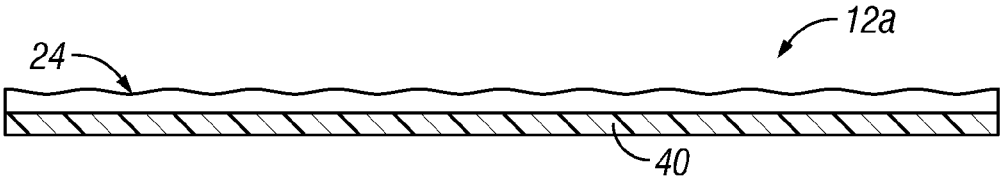
FIG. 3 is a cross-sectional view through line 3-3 of FIG. 2.
Figure 3A:
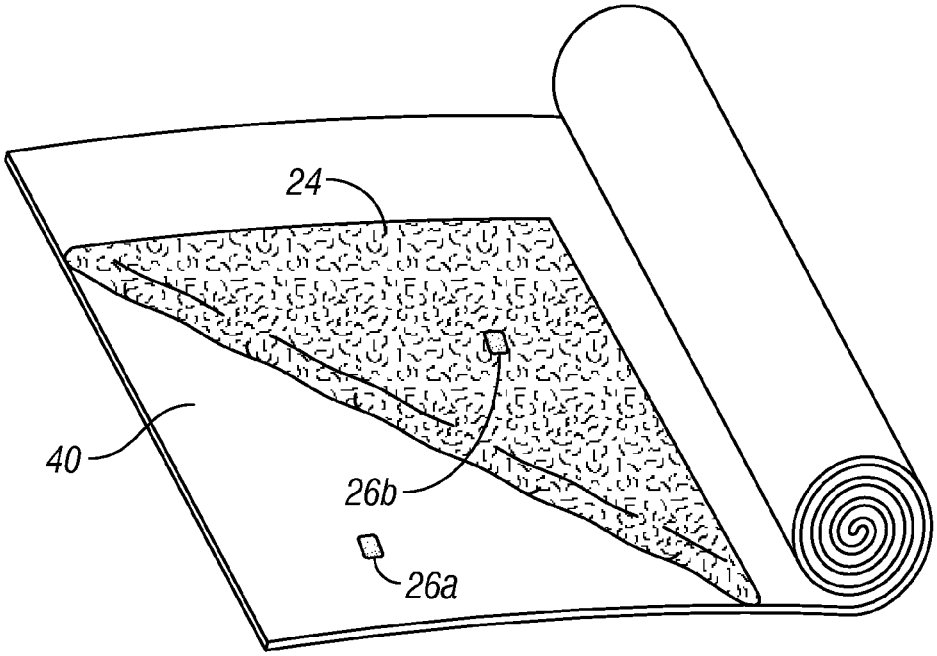

As seen in FIGS. 3 and 4, embodiments of the invention wherein the yoga mat has a removable upper layer 24, the yoga mat may comprise a bottom portion 40 formed of a elastomeric polymer or other suitable material, the underside of which will preferably engage an underlying floor surface so as not to slip on the floor surface during use. The connectors 26 comprise first connector members 26*a* on the upper surface of the bottom portion 40 are releasably engageable with corresponding second connectors 26*b* on the underside of the removable upper surface 24 to firmly hold the upper surface 24 in place on the bottom portion 40 during use. Preferably, the connectors 26 are positioned and constructed so as not to create hard areas, lumps or bumps in the yoga mat 12*a* which would be uncomfortable to or cause interference with the user's performance of yoga on the mat 12*a*. At the same time, however, the connectors 26 will preferably hold the upper surface 24 in place without wrinkling, puckering or sliding of the upper surface 24 relative to the bottom portion 40. In this regard connectors 26 comprising flat adhesive strips or flat strips of hook and loop (Velcro) connector material may be advantageous for this application. In some embodiments, a temporary adhesive may present on all or part of the upper surface of the lower member and/or undersurface of the removable upper member 24 as an alternative to discrete individual connectors 26.

Figure 2B:
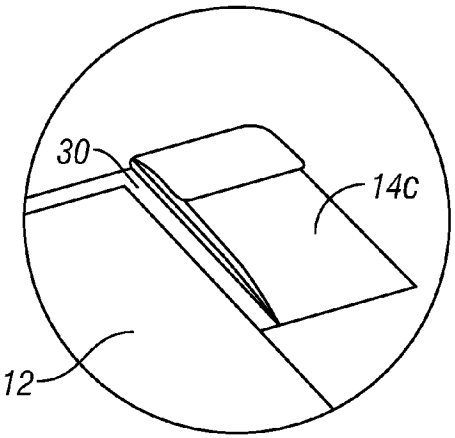
FIG. 2B is a diagram showing an example of a storage compartment attached to a yoga mat by way of a zipper in accordance with the present invention.
Figure 2C:
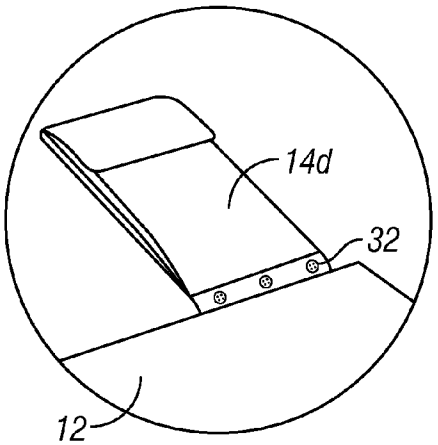
FIG. 2C is a diagram showing an example of a storage compartment attached to a yoga mat by way of buttons in accordance with the present invention.
Figure 2D:
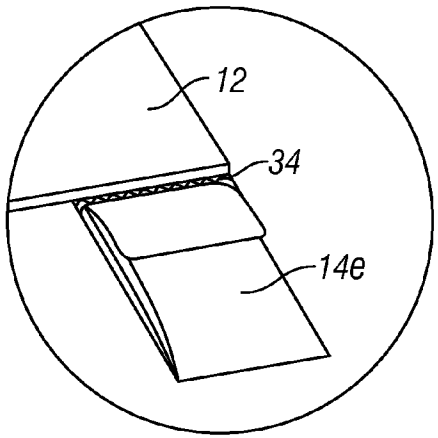
FIG. 2D is a diagram showing an example of a storage compartment sewn or stitched to a yoga mat in accordance with the present invention.
Figure 2E:
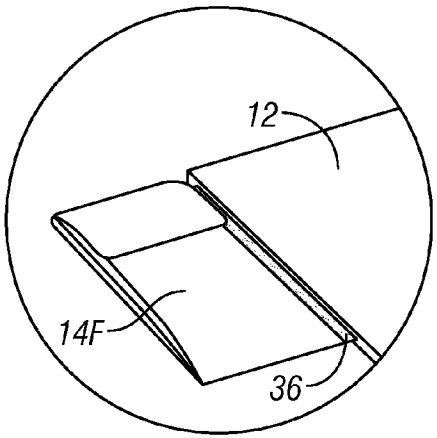
FIG. 2E is a diagram showing an example of a storage compartment attached to a yoga mat by way of hook and loop (Velcro) connection material in accordance with the present invention.

FIGS. 2A through 2E show non-limiting examples of ways in which the storage compartment(s) 14 may be permanently or detachably connected to a yoga mat 12. Specifically, in FIG. 2A a storage compartment 14*b* comprising a pocket with a closure flap is attached to a corner of a yoga mat 12 by snaps 28. In FIG. 2B a similar storage compartment 14*c* is attached laterally to an edge of a yoga mat 12 by a zipper 30. In FIG. 2C a similar storage compartment 14*c* is attached at its bottom end to an edge of a yoga mat by buttons 32. In FIG. 2D, the top end of a similar storage compartment 14*e* is permanently attached to an edge of a yoga mat 12 by a sewn seem or stitching 34. In FIG. 2E a similar storage compartment 14*f* is attached laterally to an edge of a yoga mat 12 by hook and loop fastener material (Velcro) 36. It is to be understood that the ways in which storage compartment(s) 14 may be attached to yoga mats according to the present invention are not limited to only the specific attachment means shown in these examples. Any suitable attachment apparatus or material may be used, including where applicable the following: zippers, buttons, snaps (metallic and plastic), magnets, stitching, sewing, nails, staples, rings such as key rings, hooks; slides, purse feet, swivel hooks, chains such as key chains, hook and eye connectors, dill fashion bubbles, screws, pins, wires, clasps, D-rings, buckles such as vest buckles, nickel eyelets, magnetic snaps, snap eyelets, needles, fork pins, hinges, tacks such as thumbtacks, clips such as bondage clips, paper clips or binder clips, Blutac material, dress pins, notions, thread, ties: yarn, laces, trim, ribbons, safety pins, buckles; snap buckles, knobs, cords, zip ties, tape such as cloth tape, glues such as hot melt glue, fabric glues and adhesives, heat & bond fabrics, gripper snaps, twine, string, rubber bands, heat sink, Velcro dots, Velcro tape, electrically charged surfaces or members that are electrically connected to one another, fasteners, grommets, third hand tools, rubber cement, clear gum, fabric fusion, welding, fusible bias, strap slides and rings, clear straps, cotton and polyester webbing, spiral binding, solder wire, Uhu-glue, dowel, Oxystrap, epoxy resins, masking tapes, duct tapes, gaffe tapes, double-sided tapes, comb bindings, Bodog clips, pushpins, gums such as arabic gum or Tarzan grips. Also, the terms "attached" or "connected" as used in relation to the storage compartment(s) 14 of this invention include forming the storage compartments integrally or continuously with all or part of the yoga mat 12 such that the storage compartment(s) 14 and yoga mat 12 comprise a unitary (e.g., single or integrated) structure which includes the storage compartment(s) 14.

Figure 4A:
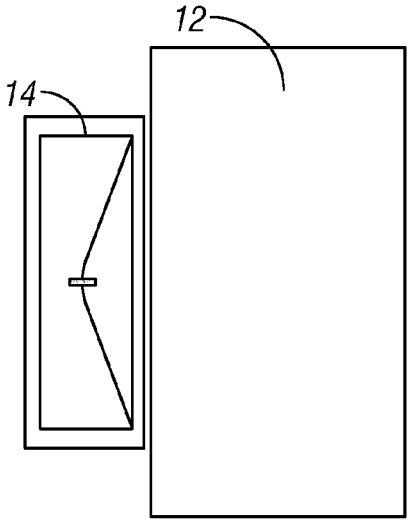
FIG. 4A shows a top view of a yoga mat of the present invention having a storage compartment which comprises a large pouch sized to additionally function as a carrying case for the yoga mat.

FIGS. 4A through 4I show various non-limiting examples of variations in the size, number, location and type of storage compartment(s) used on yoga mats of the present invention. Specifically, FIG. 4A shows a yoga mat 12 with storage compartment 14 wherein the storage compartment 14 comprises sized to additionally function as a carrying case for the yoga mat. Thus, during use of the yoga mat 12, this storage compartment may be attached to one side of the yoga mat 12 as shown and used for storage of ancillary or personal items. After the user has completed a yoga session, the storage compartment may be detached from the mat 12, the mat 12 may be rolled or folded and placed inside the storage compartment 14 so that the storage compartment 14 then acts as a carrying case for the mat 12. In such embodiments where the storage compartment doubles as a carrying case, it may optionally include a handle, shoulder strap or other suitable accessory to facilitate carrying of the article.

Figure 4B:
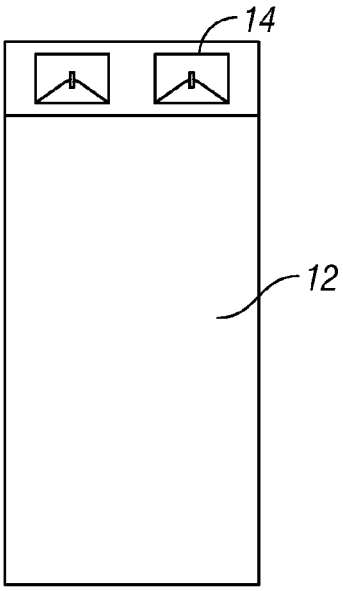
FIG. 4B shows a top view of a yoga mat of the present invention having a plurality of storage compartments on a common base member which is attached to one end of the yoga mat.

FIG. 4B shows yoga mat 12 having a plurality of storage compartments 14 on a common base member which is attached to one end of the yoga mat 12.

Figure 4C:
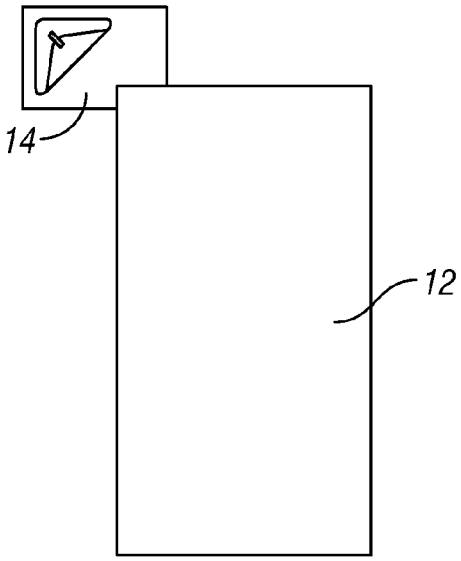
FIG. 4C shows a top view of a yoga mat of the present invention having a storage compartment attached to a corner of the yoga mat.

FIG. 4C shows yoga mat 12 having a single storage compartment 14 attached to a corner of the yoga mat 12.

Figure 4D:
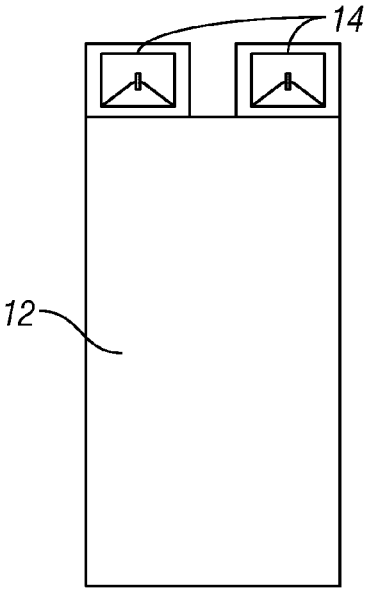
FIG. 4D shows a top view of a yoga mat of the present invention having a plurality of storage compartments mounted on separate base members attached to one end of the yoga may.

FIG. 4D shows a yoga mat 12 having two separate storage compartments 14 attached at separate, spaced-apart locations on one end of the yoga mat 12.

Figure 4F:
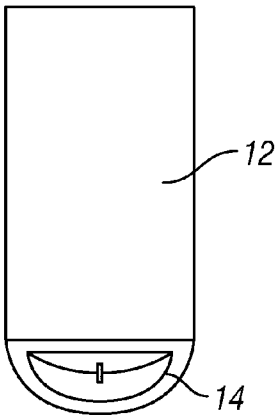
FIG. 4F shows a top view of a yoga mat of the present invention having a non-rectangular storage compartment attached to one end of the yoga mat.
Figure 4E:
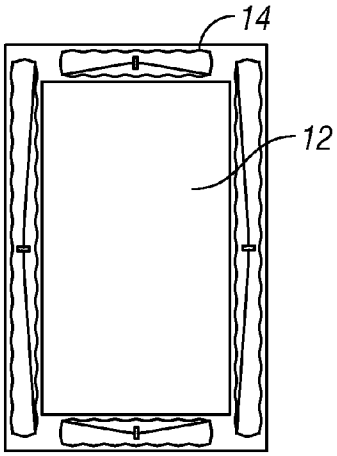
FIG. 4E shows a top view of a yoga mat of the present invention having a storage compartments attached to all four sides of the yoga mat.

FIG. 4E shows a yoga mat 12 having a storage compartments 14 attached to all four sides of the yoga mat.

FIG. 4F shows a yoga mat 12 having a non-rectangular storage compartment 14 attached to one end of the yoga mat 12.

Figure 4I:
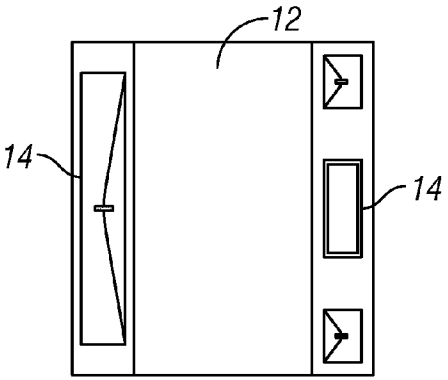
FIG. 4I shows a top view of a yoga mat of the present invention having a plurality of storage compartments attached to opposite sides of the yoga mat, wherein the storage compartments include flexible pouches of varying size as well as a rigid box-type storage compartment.
Figure 4H:
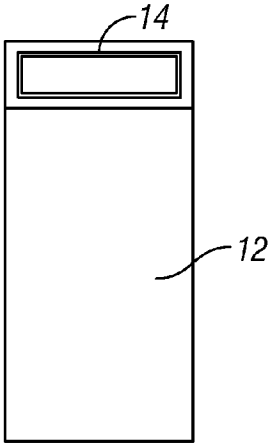
FIG. 4H shows a top view of a yoga mat of the present invention having a rigid box type storage compartment attached to the yoga mat.
Figure 4G:
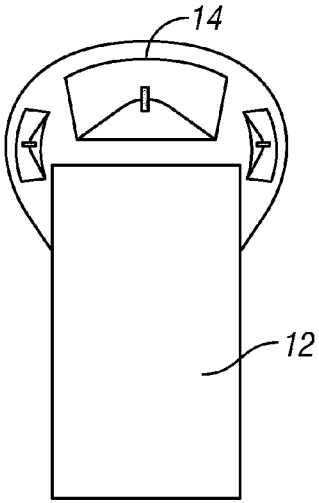
FIG. 4G shows a top view of a yoga mat of the present invention having a plurality of non-rectangular storage compartments attached to one end and portions of the two opposite sides of the yoga mat.

FIG. 4G shows a yoga mat 12 of the present invention having a plurality of non-rectangular storage compartments 14 attached to one end and portions of the two opposite sides of the yoga mat 12.

FIG. 4H shows a yoga mat 12 having a rigid box type storage compartment 14 attached to one end of the yoga mat 12.

FIG. 4I shows yoga mat 12 having a plurality of storage compartments 14 attached to opposite sides of the yoga mat 12, wherein the storage compartments include flexible pouches of varying size as well as a rigid box-type storage compartment.

It is to be appreciated that, although the invention has been described hereabove with reference to certain examples or embodiments of the invention, various additions, deletions, alterations and modifications may be made to those described examples and embodiments without departing from the intended spirit and scope of the invention. For example, any elements, steps, members, components, compositions, reactants, parts or portions of one embodiment or example may be incorporated into or used with another embodiment or example, unless otherwise specified or unless doing so would render that embodiment or example unsuitable for its intended use. Also, where the steps of a method or process have been described or listed in a particular order, the order of such steps may be changed unless otherwise specified or unless doing so would render the method or process unsuitable for its intended purpose. Additionally, the elements, steps, members, components, compositions, reactants, parts or portions of any invention or example described or shown herein may optionally exist or be utilized in the substantial absence of other elements, steps, members, components, compositions, reactants, parts or portions, unless otherwise specified. All reasonable additions, deletions, modifications and alterations are to be considered equivalents of the described examples and embodiments and are to be included within the scope of the following claims.

What is claimed is:

1. A yoga mat device comprising:

a flat yoga mat having a plurality of perimeter edges and an upper surface upon which a person may practice yoga; and a storage compartment which has a bottom end, a top end opposite the bottom end, a base panel that extends from an edge of the top end to and edge of the bottom end and an opening in the top end through which an item is insertable into an inner storage area that extends above the base panel and between the opening in the top end of the storage compartment and the bottom end of the storage compartment;

the bottom end of the storage compartment having one or more connectors useable to alternately connect and disconnect the bottom end of the storage compartment to a perimeter edge of the mat such that, when so connected the base panel of the storage compartment will lie on a flat floor surface next to the perimeter edge of the mat with said opening in the top end of the storage compartment directed laterally away from the perimeter edge of the mat and the inner storage area extending above the base panel and between the opening in the top end that and the bottom end that is connected to the perimeter edge of the yoga mat and further such that no portion of the storage compartment occupies or extends over any portion of the mat's upper surface.

2. A method for using the yoga mat device of claim 1, said method comprising:

placing the yoga mat on a floor with the upper surface of the yoga mat facing upwardly;

causing the bottom end of the storage compartment to be attached to a perimeter edge of the yoga mat with the storage compartment lying on the floor next to the yoga mat with its top end opposite the bottom end and directed away from the yoga mat and no portion of the storage compartment occupying or extending over any portion of the mat's upper surface;

inserting an item through the opening and into the inner storage area; and practicing yoga on the upper surface of the mat.

3. A method according to claim 2 wherein the storage compartment has a closure for closing the opening and wherein the method further comprises the step of using the closure to close the opening after the item has been inserted through the opening and into the inner storage area.

4. A method according to claim 3 further comprising, after the step of practicing yoga:

removing the item from the inner storage area of the storage compartment; and inserting the yoga mat through the opening and into the inner storage area of the storage compartment.

5. A method according to claim 2 wherein the storage compartment is also useable as a carrying case for the yoga mat and wherein the method further comprises:

removing the yoga mat from the storage compartment before placing the yoga mat on the floor.

6. A method according to claim 5 further comprising detaching the bottom end of the storage compartment from the perimeter edge of the mat before inserting the yoga mat through the opening and into the inner storage area of the storage compartment.

7. A device according to claim 1 wherein the storage compartment comprises a pocket or pouch.

8. A device according to claim 1 wherein the storage compartment comprises a box.

9. A device according to claim 1 wherein the storage compartment is sized so that the mat may be folded or rolled and stored inside the storage compartment when the mat is not in use.

10. A device according to claim 1 wherein the mat has ends and sides and wherein at least one storage compartment is alternately attachable to and detachable from just one side or end of the mat.

11. A device according to claim 1 wherein the mat has ends and sides and wherein at least one storage compartment is attached to a plurality of sides and/or ends of the mat.

12. A device according to claim 1 wherein the bottom end of the storage compartment is alternately attachable to and detachable from a perimeter edge of the mat by buttons, snaps, zippers, Velcro or other hook and loop fastener material.

13. A device according to claim 1 wherein the mat has a removable upper layer.

14. A device according to claim 13 wherein the removable upper layer comprises a disposable material.

15. A device according to claim 14 wherein the disposable material comprises a paper or paper towel material.

16. A device according to claim 13 wherein the removable upper layer comprises a cleanable reusable material.

17. A device according to claim 16 wherein the reusable material comprises cotton fabric, polyester fabric, terry fabric, fleece, Sherpa fleece, microfiber material, a towel or a yoga towel.

18. A device according to claim 13 wherein the mat comprises a lower portion upon which the upper layer is removably attached, wherein the lower portion and upper layer have corresponding connector members which engage each other to attach the upper layer to the lower portion.

19. A device according to claim 13 wherein the mat comprises a lower portion upon which the upper layer is removably attached, wherein the lower portion and upper layer have an adhesive material therebetween to releasably adhere the upper layer to the base portion.

20. A device according to claim 1 wherein the storage compartment is attached to the may by a permanent or releasable attachment means.

21. A device according to claim 1 wherein the storage compartment is formed integrally with the mat such that the mat and storage compartment comprise a unitary structure.

22. A device according to claim 1 wherein the storage compartment further comprises a closure for closing the opening.

23. A yoga mat device upon which a person may practice yoga and having perimeter edges and comprising a lower portion and an upper surface removably attached to the lower portion, wherein the lower portion has a bottom side that is positionable on a floor surface and an upper side upon which the removable upper surface is attached;

wherein said yoga mat device further comprises a storage compartment which has a bottom end having one or more connectors useable to alternately connect and disconnect the bottom end of the storage compartment to a perimeter edge of the yoga mat, a top end opposite the bottom end and an opening in the top end through which an item is insertable into an inner storage area that extends between the opening in the top end and the bottom end which has said one or more connectors useable to alternately connect and disconnect the bottom end of the storage compartment to a perimeter edge of the yoga mat;

said one ore more connectors on the bottom end of the storage compartment being attachable to a perimeter edge of the yoga mat device such that the entire storage compartment will lie on the floor surface next to the mat with the opening in the top end of the storage compartment directed laterally away from the perimeter edge and the inner storage area extends between said opening in the top end of the storage compartment and the bottom end of the storage compartment that is connected to a perimeter edge of the yoga mat and further such that no portion of the storage compartment occupies or extends over any portion of the mat's upper surface.

24. A device according to claim 23 wherein the removable upper layer comprises a disposable material.

25. A device according to claim 24 wherein the disposable material comprises a paper or paper towel material.

26. A device according to claim 23 wherein the removable upper layer comprises a reusable material that may be laundered.

27. A device according to claim 26 wherein the reusable material comprises cotton fabric, polyester fabric, terry fabric, fleece, Sherpa fleece or microfiber material.

* * * * *